United States Patent [19]

Hill

[11] 4,075,997

[45] Feb. 28, 1978

[54] SPARK IGNITION SYSTEMS FOR INTERNAL COMBUSTION ENGINES

[75] Inventor: William Frank Hill, Stafford, England

[73] Assignee: Lucas Electrical Co., Limited, Birmingham, England

[21] Appl. No.: 691,439

[22] Filed: Jun. 1, 1976

Related U.S. Application Data

[63] Continuation of Ser. No. 515,067, Oct. 15, 1974, abandoned.

[30] Foreign Application Priority Data

Oct. 19, 1973 United Kingdom ..... 48845/73

[51] Int. Cl.[2] ..... F02P 1/02

[52] U.S. Cl. ..... 123/148 E; 123/146.5 A

[58] Field of Search ..... 123/148 E, 146.5 A

[56] References Cited

U.S. PATENT DOCUMENTS

| | | | |
|---|---|---|---|
| 3,791,364 | 2/1974 | Saita | 123/148 E |
| 3,831,570 | 8/1974 | Compton et al. | 123/148 E |
| 3,838,672 | 10/1974 | Richards et al. | 123/148 E |
| 4,030,469 | 6/1977 | Chateau | 123/148 E |

OTHER PUBLICATIONS

Millman & Taub: Pulse, Digital & Switching Waveforms, pp. 192–212, © 1965.

*Primary Examiner*—Charles J. Myhre
*Assistant Examiner*—Parshofam S. Lall

[57] ABSTRACT

A spark ignition system includes a variable reluctance pick-up providing the input signal to a saturating amplifier which includes a feedback path constituted by a capacitor and a resistor in series. This amplifier has a transfer function while it is being driven towards saturation, such that its output is the sum of an integral part and a proportional part and does not saturate as a result of oscillatory high frequency spurious signals since these have a low integral. A resistor in the input of the amplifier is shorted out by a diode connected transistor when the polarity of the signal from the pick-up reverses, to increase the gain of the amplifier while it is being driven towards de-saturation, such change of polarity signalling production of a spark.

4 Claims, 3 Drawing Figures

SPARK IGNITION SYSTEMS FOR INTERNAL COMBUSTION ENGINES

This is a continuation of application Ser. No. 515,067 filed Oct. 15, 1974, now abandoned.

BACKGROUND OF THE INVENTION

This invention relates to spark ignition systems for internal combustion engines.

SUMMARY OF THE INVENTION

A system according to the invention includes a variable reluctance pick-up producing output pulses when sparks are to be produced, a spark circuit operable by the pulses for producing sparks, and control means minimising the risk of spurious signals in the pick-up producing a spark, said control means including a saturating amplifier which when it de-saturates results in production of a spark, the arrangement being such that spurious signals do not saturate the amplifier.

DETAILED DESCRIPTION OF A PREFERRED EMBODIMENT

Figure 1:
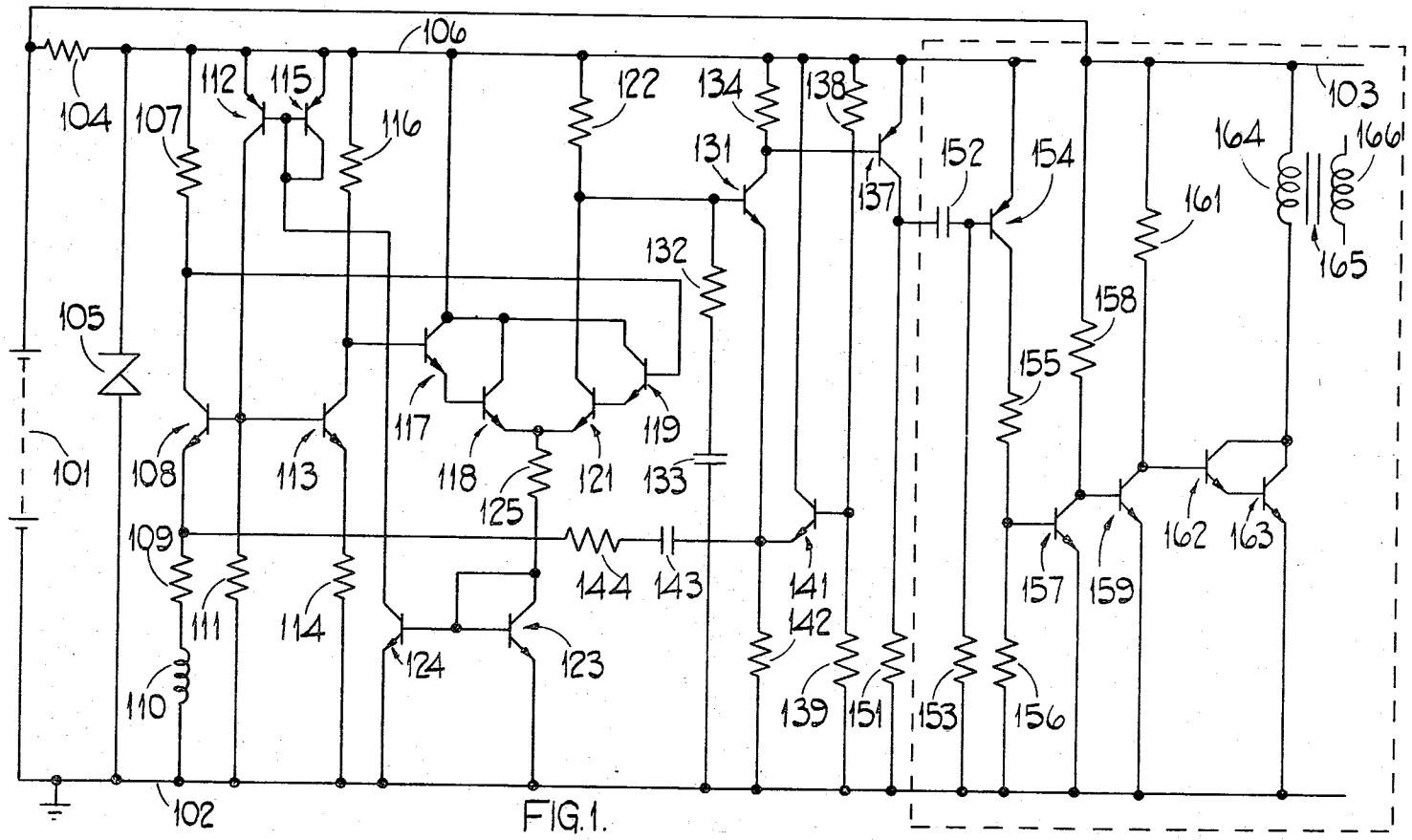
FIG. 1 is a circuit diagram illustrating one example of the invention.
Figure 2:
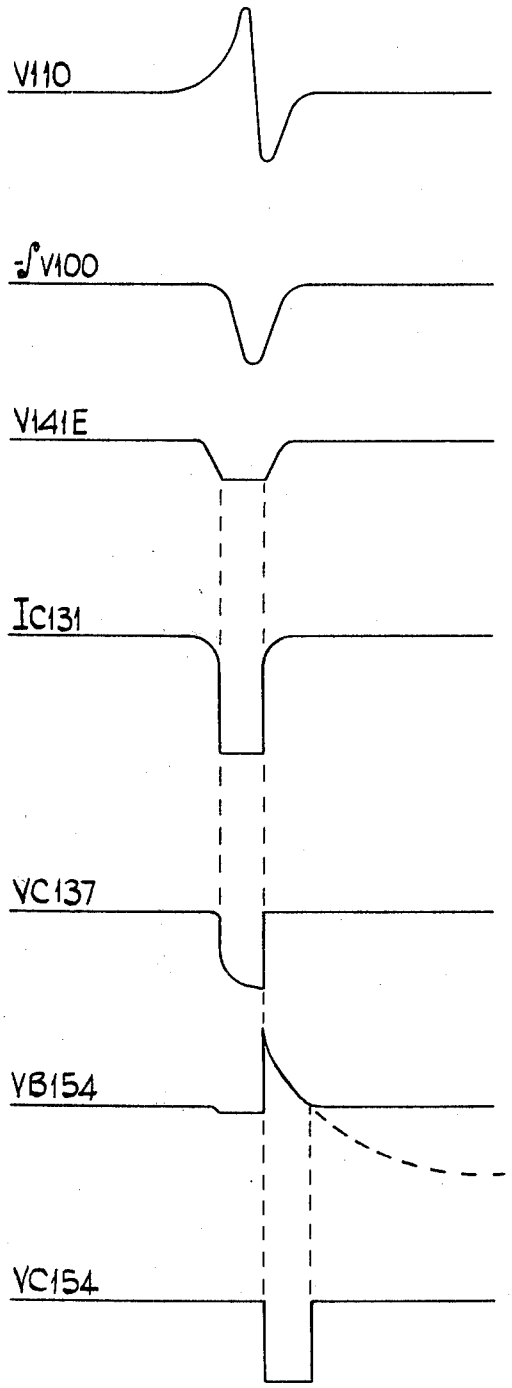
FIG. 2 shows waveforms at various points in the circuit of FIG. 1.

Referring to FIGS. 1 and 2, a vehicle battery 101 has its negative terminal connected to an earthed supply line 102 and its positive terminal connected to a supply line 103, and further connected to the line 102 through a resistor 104 and a Zener diode 105 in series, the junction of the resistor 104 and Zener diode providing power to a regulated positive supply line 106. The line 106 is connected through a resistor 107 to the collector of an n-p-n transistor 108 having its emitter connected to the line 102 through a resistor 109 and a variable reluctance pick-up 110 in series. The base of the transistor 108 is connected to the line 102 through a resistor 111, to the collector of a p-n-p transistor 112 and to the base of an n-p-n transistor 113 having its emitter connected through a resistor 114 to the line 102. The base of the transistor 112 is connected to the base and collector of a p-n-p transistor 115, and the emitters of the transistors 112, 115 are connected to the line 106. The transistor 113 has its collector connected through a resistor 116 to the line 106, the collector being further connected to the base of an n-p-n transistor 117 having its emitter connected to the base of an n-p-n transistor 118, the collectors of the transistors 117, 118 being connected to the line 106. The collector of the transistor 118 is further connected to the collector of an n-p-n transistor 119 having its emitter connected to the base of an n-p-n transistor 121 the collector of which is connected through a resistor 122 to the line 106. The base of the transistor 119 is connected to the collector of the transistor 108, and the emitters of the transistors 118, 121 are connected through a resistor 125 to the collector and base of an n-p-n transistor 123 having its emitter connected to the line 102. The base of the transistor 123 is connected to the base of an n-p-n transistor 124, and the transistor 124 has its emitter connected to the line 102 and its collector connected to the bases of the transistors 112, 115.

The collector of the transistor 121 is further connected to the base of an n-p-n transistor 131 and, through a resistor 132 and a capacitor 133 in series, to the line 102. The collector of the transistor 131 is connected through a resistor 134 to the line 106, and is further connected to the base of a p-n-p transistor 137. Also connected between the lines 106, 102 are a pair of resistors 138, 139 in series, the junction of the resistors 138, 139 being connected to the base of an n-p-n transistor 141, the collector of which is connected to the line 106. The emitters of the transistors 131, 141 are connected to the line 102 through a resistor 142, and to the emitter of the transistor 108 through a capacitor 143 and a resistor 144 in series. The transistor 137 has its emitter connected to the line 106, and its collector connected to the line 102 through a resistor 151.

The collector of the transistor 137 provides the input to an ignition drive circuit 186, the resistor 151 being bridged by a capacitor 152 and a resistor 153 in series. The junction of the capacitor 152 and resistor 153 is connected to the base of a p-n-p transistor 154, the emitter of which is connected to the line 106 and the collector of which is connected to the line 102 through a pair of resistors 155, 156 in series. The junction of the resistors 155, 156 is connected to the base of an n-p-n transistor 157, the emitter of which is connected to the line 102 and the collector of which is connected through a resistor 158 to the line 103. The collector of the transistor 157 is also connected to the base of an n-p-n transistor 159, the emitter of which is connected to the line 102 and the collector of which is connected through a resistor 161 to the line 103, and is further connected to the base of an n-p-n transistor 162 having its emitter connected to the base of an n-p-n transistor 163, the emitter of which is connected to the line 102. The collectors of the transistors 162, 163 are connected to the line 103 through the primary winding 164 of an ignition transformer 165, the secondary winding 166 of which is connected to the spark plugs of the engine in turn through a conventional distributor.

The pick-up 110 produces an output consisting of a positive half-cycle followed by a negative half-cycle. When the pick-up output is zero, the differential amplifier constituted by the transistors 117, 118, 119, 121 produces an output such that the transistors 131 and 137 are conducting. The transistor 154 is held on by current flow through the resistor 153, and so holds on the transistor 157, which in turn holds off the transistor 159. The transistors 162 and 163 conduct so that current flows in the primary winding 164.

When the positive half-cycle from the pick-up commences, it tends to turn off the transistor 108, so that the transistors 119, 121 increase in conduction and less base current flows to the transistor 131, which therefore starts to turn off. Negative feedback is provided by way of the capacitor 143 and resistor 144, and this negative feedback limits the rate of change at the emitter of the transistor 108. However, as the emitter potential of the transistor 131 falls, a point is reached at which the transistor 141 conducts, this point being set by the resistors 138, 139. When this point is reached, then the emitter potential of the transistor 131 is clamped by the transistor 141, and so there is no further negative feedback. The signal at the emitter of the transistor 108 now turns the transistor 131 off rapidly, and so the transistor 137 turns off. In consequence, capacitor 152 charges via resistor 151 and the base emitter junction of 154, which of course remains fully conducting during this process. As the polarity of the input signal reverses, transistor 131 abruptly turns on again, which turns on transistor 137 also. Transistor 154 is accordingly reverse biased by virtue of the change in collector potential of transistor 137 being coupled to the base of transistor 154 by capacitor 152. This capacitor consequently discharges via resistor 153, and transistor 154 is turned on again at the end of this discharging process. Accordingly, the current in ignition coil primary 164 is interrupted for a time determined by the discharging of capacitor 152 and starting with the resumption of conduction in transistor 131. A spark is generated as a result of the interruption of current in the ignition coil primary at this time.

The types of spurious signal encountered in the application are characterised by large amplitudes and small time integrals, i.e. they are a type known as oscillatory high-frequency spikes. Transistors 108 to 131 constitute an 'operational amplifier' having a transfer function principally determined by capacitor 143 and resistors 109 and 144. These components give the amplifier a proportional plus integral response to input signals, amounting to approximate operation as an integrator at low frequencies and a low gain proportional amplifier at high frequencies. The high frequency gain, determined by the ratio of resistor 144 to resistor 109 is insufficient to enable spurious signals to cause transistor 131 to turn off. Likewise their integral is insufficient to produce any significant voltage changes across capacitor 143. In contrast, the legitimate signal has a substantial time integral over its first half cycle under all conditions of operation, adequate to drive off transistor 131 in the manner indicated. Resistor 144 also has the effect of preventing delay in the resumption of conduction in transistor 131 following the reversal of signal input polarity which would otherwise occur at high speeds as a result of storing excess charge on capacitor 143 following saturation of the operational amplifier.

If a spurious signal is received at the pick-up 110, then the emitter potential of the transistor 131 does not change sufficiently to turn the transistor 141 on, and so the transistor 137 does not turn off, and no spark is produced.

The circuit consists essentially of a combination of an amplifier and a saturating amplifier. The amplifier provides a negative signal to the ignition drive circuit until the saturating amplifier saturates. It will be noted that the arrangement of FIG. 1 permits one side of the pick-up 110 to be earthed.

The transistors 123, 124 and 112, 115 are used to provide the appropriate currents in various parts of the circuit, and are employed in place of resistors to facilitate manufacture in integrated form.

Figure 3:
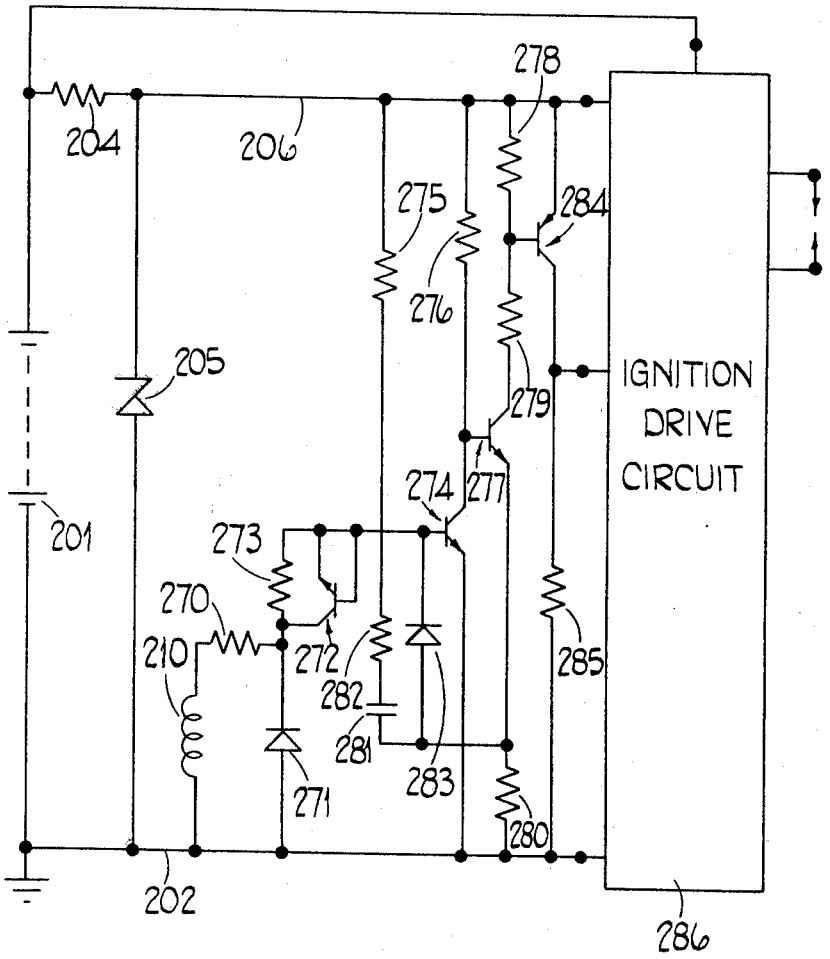
FIG. 3 is the circuit diagram of another example of the invention.

Turning now to FIG. 3, the battery 201 again has its positive polarity terminal connected via a resistor 204 to a supply rail 206 and its negative polarity terminal connected to an earth rail 202. A Zener diode 205 is connected between the rails 202 and 206 to regulate the voltage on the rail 206.

The variable reluctance pick-up 210 is connected at one end to the earth rail 202 and at the other end via a resistor 270 to the cathode of a diode 271 the anode of which is connected to the earth rail 202. An n-p-n transistor 272 has its connector connected to the cathode of the diode 271 and its emitter and base shorted together and connected by a resistor 273 to its collector. The base/emitter of the transistor 272 are connected to the base of an n-p-n transistor 274 which has its base connected by a resistor 275 to the rail 206, its collector connected by a resistor 276 to the rail 206 and its emitter connected by the earth rail 202. A transistor 277 has its base connected to the collector of the transistor 274, its collector connected to the rail 206 by two resistors 278 and 279 in series and its emitter connected via a resistor 280 to the earth rail. The amplifier constituted by the transistors 274 and 277 is provided with an a.c. negative feedback path comprising a capacitor 281 and a resistor 282 connected in series between the emitter of the transistor 277 and the base of the transistor 274. A diode 283 has its anode connected to the emitter of the transistor 277 and its cathode connected to the base of the transistor 274. A p-n-p transistor 284 has its emitter connected to the rail 206 and its collector connected to the earth rail 202 via a resistor 285. The base of the transistor 284 is connected to the interconnection of the resistors 278, 279. The collector of the transistor 284 is connected to the ignition drive circuit 286 which corresponds to the part 186 shown in FIG. 1.

When there is no output from the pick-up 210, the transistors 272 and 274 are biased by the resistor 275 so that the transistor 274 is conducting and its output voltage is clamped by the base-emitter junctions of the transistors 274 and 277 and the diode 283. The transistor 277 is conducting and most of its collector current flows through the base-emitter junction of the transistor 284 which is saturated. The transistors 272 and 274 are either mounted very close to one another or are in one encapsulation so that their temperatures can track over the temperature range and the d.c. biasing condition of the transistor 274 is maintained constant.

When the positive going pulse of the pick-up output signal commences, the base-collector junction of the transistor 272 is reverse biased, the transistor 274 tends to saturate and the voltage on the collector of the transistor 274 decreases so that diode 283 is turned off. The a.c. negative feedback path referred to limits the rate of change of this collector voltage, but eventually the transistor 274 saturates and transistors 277 and 284 are turned off which is detected as a negative going edge of a pulse on the resistor 285.

When the output of the pick-up 210 becomes negative, the base collector junction of the transistor 272 becomes forward biased thus short circuiting the resistor 273. The transistor 274 tends to cut off and the voltage on its resistor rises, at a rate determined by the negative feedback path. When the transistor 274 comes out of saturation, the transistors 277 and 284 start conducting again which is detected as a positive going edge on the resistor 285. The diode 283 starts conducting again and limits the charge on the capacitor 281, as the negative signal increases.

When the transistor 272 shorts out the resistor 273 the transfer function of the operational amplifier effectively constituted by the transistors 274 and 277 is changed, so that with the transistor 272 shorting the resistor 273 the configuration provides an output which is mainly proportional to the pick-up signal, whereas with the transistor 272 effectively open circuit the output is a combination of integral plus proportional with lower gain. This change over occurs at the instant when the pick-up signal crosses zero, which is the instant when a spark output is required. The delay in the spark initiation time as a result of integration is therefore minimised.

As in the first embodiment spurious signals in the form of oscillatory high-frequency spikes do not provide a sufficient integral component to cause the transistor 274 to saturate so that spark initiation is not effected.

I claim:

1. A spark ignition system for an internal combustion engine comprising:

a variable reluctance pick-up for producing output pulses which change in polarity when sparks are to be produced;

a spark circuit operated by said output pulses; and control means for coupling said variable reluctance pick-up to said spark circuit, said means including an operational amplifier, an input resistor, connecting said pick-up directly to said amplifier input, and an AC negative feedback path comprising a resistor and a capacitor in series between the output and input of the operational amplifier, such that each pulse from said pick-up drives the amplifier relatively slowly into saturation when the pick-up pulse is of one polarity and drives the amplifier relatively quickly out of saturation when the pulse changes polarity, said spark circuit operating to produce a spark when said amplifier is driven out of saturation.

2. A system as claimed in claim 1 in which the operational amplifier includes a diode connected to short-circuit a resistor in the input of the operational amplifier when the output of the pick-up reverses in polarity so as to increase the gain of the operational amplifier when the latter is being driven out of saturation and thereby to reduce the delay in desaturation.

3. A system as claimed in claim 2 in which said diode is a transistor connected as a diode.

4. A system as claimed in claim 3 in which said operational amplifier comprises a positive supply rail and an earth rail, first and second n-p-n transistors with the base of the second n-p-n transistor connected to the collector of the first, a collector resistor for the first n-p-n transistor connecting its collector to the supply rail, a pair of resistors in series connecting the collector of the second n-p-n transistor to the supply rail, an emitter resistor for the second n-p-n transistor connecting the emitter thereof to the earth rail, said feedback path connecting the emitter of the second n-p-n transistor to the base of the first, a pair of input resistors in series connecting one end of the pick-up to the base of the firse n-p-n transistor, one of said input resistors having said diode-connected transistor connected across it, the other end of the pick-up being connected to the earth rail, a bias resistor for the first n-p-n transistor connected between the base thereof and the supply rail and a diode with its anode connected to the emitter of the second n-p-n transistor and its cathode connected to the base of the first n-p-n transistor to limit the charge on the capacitor in the feedback path.

* * * * *